US006449339B2

(12) United States Patent
Yasutake

(10) Patent No.: US 6,449,339 B2
(45) Date of Patent: Sep. 10, 2002

(54) ROTARY ANODE TYPE X-RAY TUBE AND X-RAY TUBE APPARATUS PROVIDED WITH THE SAME

(75) Inventor: Hiroto Yasutake, Otawara (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/880,129

(22) Filed: Jun. 14, 2001

(30) Foreign Application Priority Data

Jun. 15, 2000 (JP) ..... 2000-179888
Feb. 26, 2001 (JP) ..... 2001-050574

(51) Int. Cl.[7] ..... H01J 35/10
(52) U.S. Cl. ..... 378/144; 378/141; 378/132
(58) Field of Search ..... 378/144, 141, 378/143, 131, 132, 133

(56) References Cited

U.S. PATENT DOCUMENTS 5,224,142 A 6/1993 Ono et al.
5,384,818 A 1/1995 Ono et al.
5,583,906 A * 12/1996 Suguira et al. ..... 378/132

* cited by examiner

*Primary Examiner*—David P. Porta
*Assistant Examiner*—Elizabeth Gemmell
(74) *Attorney, Agent, or Firm*—Pillsbury Winthrop LLP

(57) ABSTRACT

Disclosed is a rotary anode type X-ray comprising a substantially columnar stator, a cylindrical first rotor coupled around the stator, at least one hydrodynamic slide bearing region including a spiral groove, and arranged in the coupled portion between the stator and the first rotor, and a cylindrical second rotor arranged coaxial with and outside the first rotor with a gap for the heat insulation and bonded directly or indirectly to a anode disk, the second rotor being bonded to the first rotor in an open edge region positioned remote from the anode disk in terms of the heat transmission route, wherein a plurality of slits extending substantially along the axis of rotation are formed apart from each other in the circumferential direction in the open edge region in which the second rotor is bonded to the first rotor.

6 Claims, 6 Drawing Sheets

ROTARY ANODE TYPE X-RAY TUBE AND X-RAY TUBE APPARATUS PROVIDED WITH THE SAME

CROSS-REFERENCE TO RELATED APPLICATIONS

This application is based upon and claims the benefit of priority from the prior Japanese Patent Applications No. 2000-179888, filed Jun. 15, 2000; and No. 2001-050574, filed Feb. 26, 2001, the entire contents of both of which are incorporated herein by reference.

BACKGROUND OF THE INVENTION

The present invention relates to a rotary anode type X-ray tube and an x-ray tube apparatus provided with the same, particularly, to a rotary anode type X-ray tube equipped with a hydrodynamic type slide bearing having a spiral groove and an X-ray tube apparatus having the rotary anode type X-ray tube incorporated therein.

A rotary anode type X-ray tube comprises a rotary anode disk provided with a target region for emitting an X-ray, a rotary mechanism rotatably supporting the rotary anode disk directly or with a supporting shaft arranged therebetween, and a cathode for irradiating the target region with an electron beam. This rotary anode disk, the rotary mechanism and the cathode are arranged within a vacuum envelope. The rotary mechanism for supporting the rotary anode disk comprises a rotary structure having bearing sections formed between the rotary anode disk and the rotary mechanism and a stationary structure.

In the X-ray tube apparatus comprising the rotary anode type X-ray tube described above, a rotating magnetic field is generated from a stator electromagnetic coil arranged outside the vacuum envelope of the X-ray tube so as to rotate the rotary anode disk jointed to the rotating mechanism at high speed using the principle of an electromagnetic induction motor. As a result, the target region of the rotary anode disk is irradiated with the electron beam generated from the cathode so as to allow an X-ray to be emitted from the target region.

The rotary mechanism of the conventional rotary anode type X-ray tube, which rotatably supports the rotary anode disk, will now be described with reference to FIGS. 1 and 2. As shown in FIGS. 1 and 2, the rotary mechanism comprises a supporting shaft 31. A rotary anode disk (not shown) provided with a target region made of a heavy metal and emitting an X-ray is fixed to the supporting shaft 31. Also, a cylindrical rotor 32 for rotatably supporting the rotary anode disk is coupled with the supporting shaft 31.

The rotor 32 is of a triple coaxial structure consisting of an outer cylinder 32*a*, an intermediate cylinder 32*b*, and an inner cylinder 32*c* having a bottom. The outer cylinder 32*a* and the intermediate cylinder 32*b* are brazed to each other to form an integral structure in an upper open region B1 shown in FIG. 1. Incidentally, the upper portion of the intermediate cylinder 32*b* is bonded directly to the supporting shaft 31.

Further, the intermediate cylinder 32*b* and the inner cylinder 32*c* are brazed to each other to form an integral structure in a lower open portion shown in FIG. 1. To be more specific, as apparent from FIG. 2 showing a lateral cross section along the line II—II shown in FIG. 1, the outer cylinder 32*a*, the intermediate cylinder 32*b* and the inner cylinder 32*c* are arranged coaxial, and the intermediate cylinder 32*b* and the inner cylinder 32*c* are integrally bonded to each other by a brazed portion B2 over the entire circumferential region in a lower end portion of the rotary mechanism.

A columnar stator (not shown) is inserted into the inner cylinder 32*c* of the rotor 32 with a small bearing clearance of about 20 $\mu$m provided between the outer circumferential surface of the stator and the inner circumferential surface of the inner cylinder 32*c*. The intermediate cylinder 32*b* is formed of, for example, a ferromagnetic material and also performs the function of a magnetism guiding section of the rotary magnetic field generated from a stator electromagnetic coil (not shown).

A heat insulating clearance G1 having a size of, for example, about 0.5 mm in the radial direction is formed between the outer cylinder 32*a* and the intermediate cylinder 32*b*. Also, a heat insulating clearance G2 having a size of, for example, about 1 mm in the radial direction is formed between the intermediate cylinder 32*b* and the inner cylinder 32*c*.

During operation of the rotary anode type X-ray tube, the target region of the rotary anode disk is irradiated with an electron beam, with the result that the rotary anode disk is heated to one thousand and several hundred degrees centigrade. The heat of the rotary anode disk is transmitted to the rotor via the supporting shaft, etc. so as to elevate the temperature of the hydrodynamic type slide bearing portion arranged between the inner cylinder 32*c* and the stator, thereby impairing the rotating characteristics of the rotor.

Such being the situation, the intermediate cylinder 32*b* that is bonded directly to the supporting shaft is generally formed of a material having a low heat conductivity in order to prevent the heat of the rotary anode disk from being transmitted to the bearing section as much as possible. Also, since heat is generated in the bearing section during operation, it is said to be desirable for the inner cylinder constituting the bearing surface to be formed of a material having a high heat conductivity in order to permit the generated heat to be dispersed and released efficiently to the outside.

As described above, the intermediate cylinder is formed of a material having a low heat conductivity, and the inner cylinder is formed of a material having a high heat conductivity. Naturally, the intermediate cylinder and the inner cylinder are formed of different materials, and the intermediate cylinder and the inner cylinder differ from each other in the thermal expansion coefficient in many cases. It follows that it is difficult in some cases to bond the intermediate cylinder and the inner cylinder by means of brazing.

To be more specific, where these cylinder members are bonded to each other by a welding material, e.g., by a gold brazing, it is necessary to heat the welding material to about 1100° C. Also, in the case of silver brazing, the welding material must be heated to about 800° C. What should be noted is that, if the intermediate cylinder and the inner cylinder differ from each other in the thermal expansion coefficient, a large difference is generated between the coupled size between the intermediate and inner cylinders at room temperature and the coupled sizes of the intermediate and inner cylinders at brazing temperature.

Suppose, for example, that the thermal expansion coefficient of the intermediate cylinder is higher than that of the inner cylinder. If the brazing is performed under the state that the intermediate and inner cylinders are exactly coupled at room temperature, the inner diameter of the intermediate cylinder is rendered larger than the outer diameter at the brazed portion of the inner cylinder under the high brazing temperature, with the result that it is possible for the intermediate and inner cylinders to be brazed to each other with a non-uniform clearance provided therebetween and with the axes of the intermediate and inner cylinders deviated from each other.

To be more specific, it is certainly possible for the intermediate cylinder and the inner cylinder to be brazed to each other with the axes of these two cylinders substantially aligned. Alternatively, it is also possible for an inconvenience to take place as shown in FIG. 3. To be more specific, it is considered possible for the intermediate and inner cylinders to be brazed to each other with the axis Cr of the intermediate cylinder 32*b* inclined by a certain angle $\alpha$ relative to the axis Co of the inner cylinder 32*c* with respect to the axis of the brazed portion B1.

Where the axes of the inner cylinder and the intermediate cylinder are deviated from each other, it is certainly possible to correct to some extent the unbalanced rotation by the processing after the brazing step. However, where the rotary structure is processed at room temperature, the balance of rotation is rendered poor at the high temperature during operation of the X-ray tube so as to render the rotation characteristics poor. Particularly, in a rotary anode type X-ray tube comprising a hydrodynamic slide bearing for high speed rotation having an angular speed of, for example, 6,000 rpm to 10,000 rpm, it is possible for a slight error in the balance of rotation to bring about a serious problem.

On the other hand, where the intermediate cylinder has a low thermal expansion coefficient, the clearance of the coupled portion, in which the intermediate cylinder and the inner cylinder are brazed to each other, is rendered large at room temperature. As a result, under a cooled state after the brazing step, the inner cylinder is shrunk greatly, with the result that it is possible for the brazed portion of the intermediate cylinder to be locally damaged, e.g., occurrence of cracks. It is also possible for the axes of the intermediate cylinder and the inner cylinder to be deviated from each other.

BRIEF SUMMARY OF THE INVENTION

An object of the present invention is to provide a rotary anode type X-ray tube free from deviation of the axes of two cylindrical rotors coaxially coupled with each other so as to exhibit satisfactory rotating characteristics and an X-ray tube provided with the particular rotary anode type X-ray tube.

According to a first aspect of the present invention, there is provided a rotary anode type X-ray tube comprising a substantially columnar stator; a first cylindrical rotor coupled around the stator; at least one hydrodynamic slide bearing including a spiral groove arranged in the coupling portion between the stator and the first cylindrical rotor; and a second cylindrical rotor arranged coaxial with and outside the first cylindrical rotor with a gap for the heat insulation provided therebetween and bonded to a rotary anode disk including a target region for emitting an X-ray formed in a part thereof, the second cylindrical rotor being bonded to the first cylindrical rotor in an open region positioned remote from the rotary anode disk in terms of the heat transmission route; wherein a plurality of slits extending substantially along the axis of rotation are formed apart from each other in the circumferential direction in that region of the second cylindrical rotor which is bonded to the first cylindrical rotor.

Also, according to a second aspect of the present invention, there is provided a rotary anode type X-ray tube apparatus, wherein a thick portion is formed in the first cylindrical rotor made of a ferromagnetic material or the second cylindrical rotor of the rotary anode type X-ray tube in a manner to partially narrow the gap for the heat insulation formed between the first and second cylindrical rotors, a plurality of slits extending substantially along the axis of rotation are formed apart from each other in the circumferential direction in that region of the second cylindrical rotor which is bonded to the first cylindrical rotor, and the iron core portion of the stator electromagnetic coil is located in the outer circumferential region in the position in the axial direction corresponding to the thick portion.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
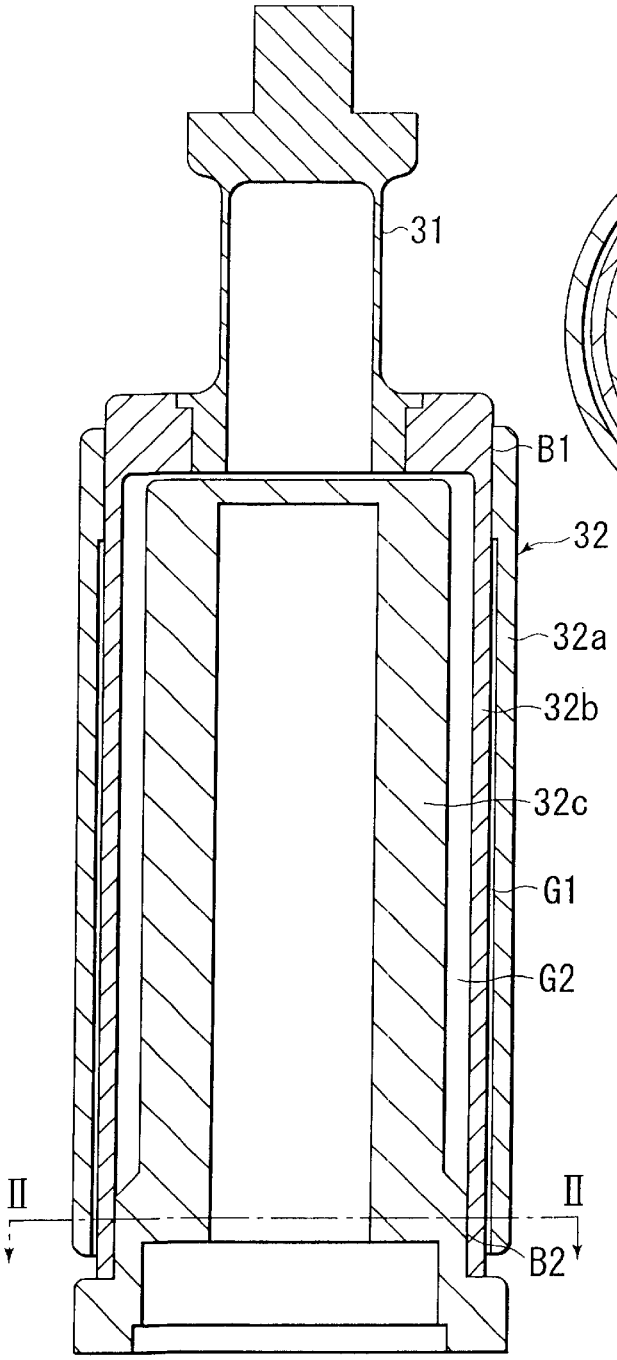
FIG. 1 (PRIOR ART)
FIG. 1 is a vertical cross sectional view schematically showing the construction of a part of a conventional rotary anode type X-ray tube apparatus.
Figure 2:
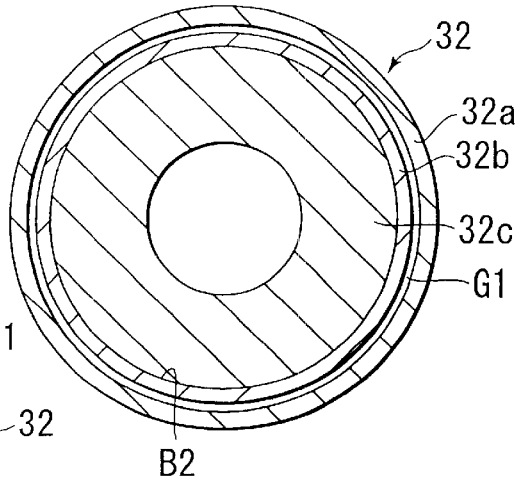
FIG. 2 (PRIOR ART)
FIG. 2 is a lateral cross sectional view along the line II—II shown in FIG. 1.
Figure 3:
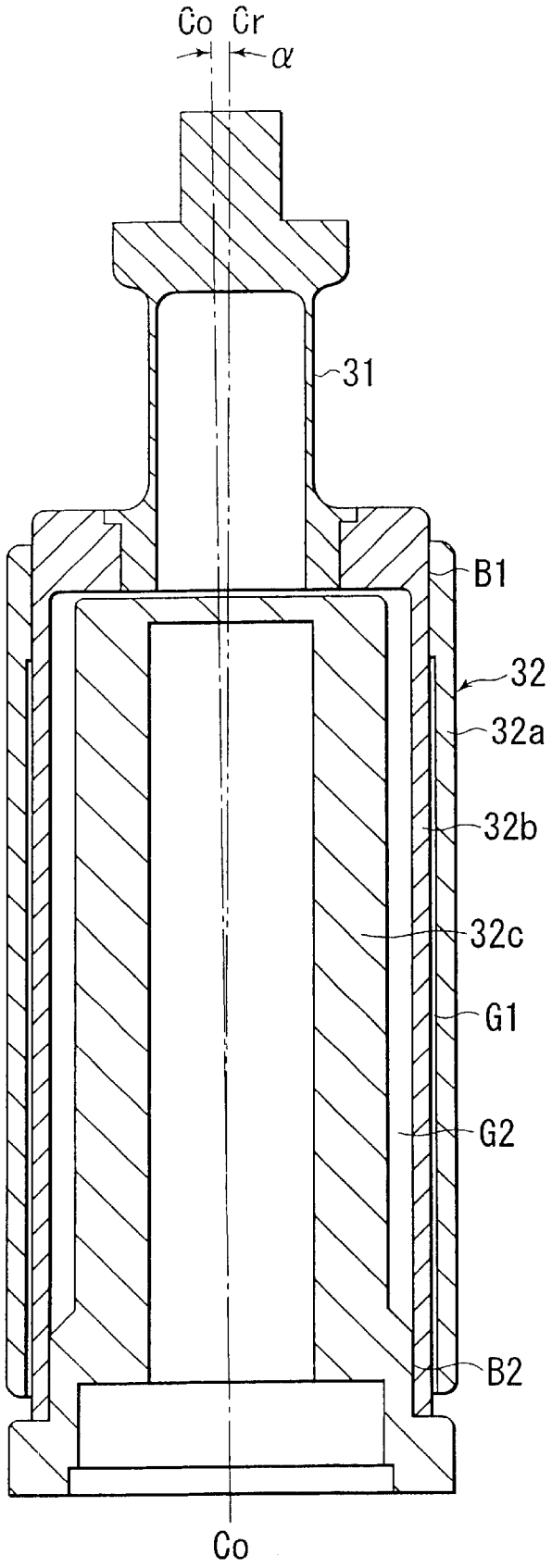
FIG. 3 (PRIOR ART)
FIG. 3 is a vertical cross sectional view schematically showing the construction of a part of a conventional rotary anode type X-ray tube apparatus and is intended to show the problem inherent in the prior art.
Figures 4A, 4B, 4C:
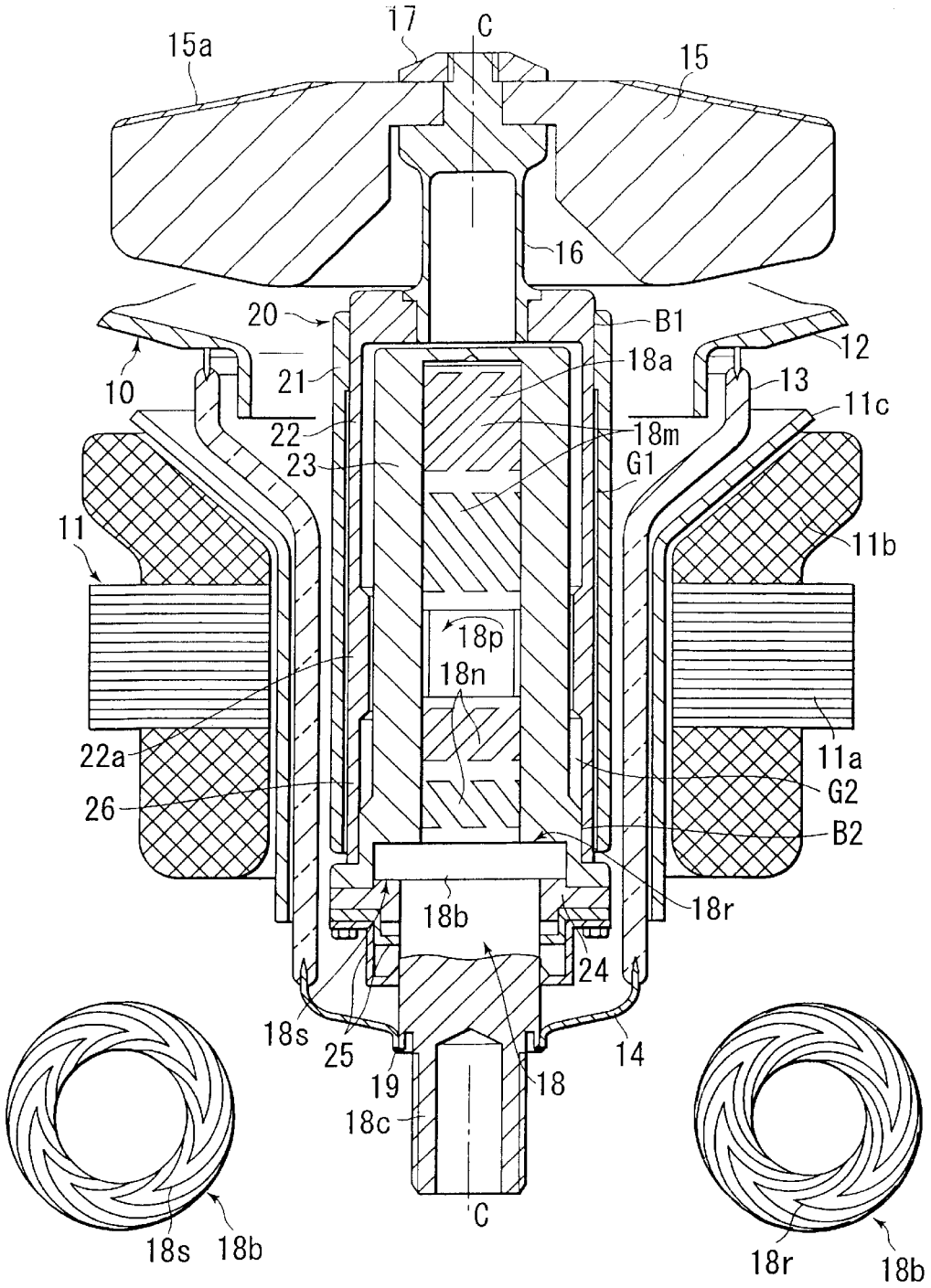
FIG. 4A is a cross sectional view schematically showing the construction of rotary anode type X-ray tube apparatus according to one embodiment of the present invention.
FIGS. 4B and 4C are cross sectional views schematically showing a large diameter portion of the stator shown in FIG. 4A.

The embodiments of the present invention will now be described with reference to the accompanying drawings. FIGS. 4A to 4C schematically shows a part of a rotary anode type X-ray tube 10 and is directed to an X-ray tube apparatus in which a stator electromagnetic coil 11 is arranged around the rotor structure.

A reference numeral 12 shown in FIG. 4A denotes a metal vessel portion of a vacuum envelope, a reference numeral 13 denotes a glass cylinder portion fused to the metal vessel portion 12 of the vacuum envelope, a reference numeral 14 denotes a sealing metal ring for hermetically sealing the vacuum envelope, a reference numeral 15 denotes a rotary anode disk, a reference numeral 15*a* denotes a target region of the rotary anode disk 15, said target region 15*a* being irradiated with an electron beam for emitting X-rays, a reference numeral 16 denotes a supporting shaft for rotatably supporting the rotary anode disk 15, a reference numeral 17 denotes a nut for fastening the rotary anode disk 15 to the supporting shaft 16, a reference numeral 18 denotes a substantially columnar stator for rotatably supporting a rotor 21 having the supporting shaft 16 fixed thereto, a reference numeral 18*a* denotes a small diameter portion of the stator 18, a reference numeral 18*b* denotes a large diameter portion of the stator 18, a reference numeral 18*c* denotes an outer edge portion of the stator 18, and a reference numeral 19 denotes a hermetic welding portion between the stator 18 and the sealing metal ring 14 of the vacuum envelope.

Further, a reference numeral 20 denotes a substantially cylindrical rotor imparting a rotating force to the supporting shaft 16, a reference numeral 21 denotes an outer cylinder of the rotor 20, a reference numeral 22 denotes an intermediate cylinder of the rotor 20, a reference numeral 23 denotes an inner cylinder of the rotor 20, a reference numeral 24 denotes a thrust ring screwed to the inner cylinder 23, and a reference numeral 25 denotes a trap ring for preventing the leakage of the lubricant. Still further, a reference numeral 11 denotes the stator electromagnetic coil for imparting a magnetic field for rotating the rotor 20, a reference numeral 11*a* denotes a ring-like iron core of the stator electromagnetic coil 11, a reference numeral 11*b* denotes a stator coil conductive wire wound about the iron core 11*a*, and a reference numeral 11*c* denotes an insulating spacer.

The stator 18 comprises spiral grooves 18*m*, 18*n* of herringbone patterns for two sets of hydrodynamic slide bearings formed in the small diameter portion 18*a* that is relatively long in the axial direction and also comprises a small diameter portion 18*p* in which a spiral groove is not formed and which is interposed between the spiral grooves 18*m* and 18*n*. Also, spiral grooves 18*r* and 18*s* of a circular herringbone pattern for the hydrodynamic slide bearings in the thrust direction are formed on the upper and lower surfaces, respectively, of the large diameter portion 18*b* of the stator 18, as shown in FIGS. 4B and 4C. A bearing gap of about 20 $\mu$m is arranged in the bearing region including each of the spiral grooves noted above and positioned between the stator 18 and the rotor 20. A metal lubricant that is liquid at least during the operation of the X-ray tube such as a Ga alloy is supplied to these bearing gaps, the spiral grooves, and the gap of the small diameter portion 19*p* formed in the stator 18 as well as to a lubricant reservoir (not shown) and a plurality of lateral passageways (not shown).

For forming, for example, the stator 18, the inner cylinder 23 of the rotor 20 and the thrust ring 24, it is possible to use, for example, a high-speed tool steel, e.g., SKD-11 specified in JIS (Japanese Industrial Standards), molybdenum (Mo) or TZM that is a trade name of Mo-0.45Ti-0.07Zr-0.02C alloy.

For forming the intermediate cylinder 22 of the rotor 20, it is desirable to use a ferromagnetic material having a relatively small heat conductivity, e.g., 0.50Fe-0.50Ni alloy. The heat conductivity of the Fe-Ni alloy is about ⅛ of that of Mo or TZM and, thus, the Fe-Ni alloy is effective for suppressing the transmission of the heat generated from the rotary anode disc 15 to the inner cylinder 23 constituting the bearing surface. Further, it is possible to use Mo or TZM, which is a metal having a high melting point, for forming the supporting shaft 16.

In general, the rotary anode disk 15 is joined to the upper end portion of the intermediate cylinder 22 via the supporting shaft 16. Alternatively, it is also possible for the rotary anode disk 15 to be bonded directly to the upper end portion of the intermediate cylinder 22.

A thick portion 22*a* protruding inward is formed in the intermediate cylinder 22 of the rotor in a position substantially corresponding to the small diameter portion 18*p* between the bearing spiral grooves 18*m* and 18*n*. The intermediate cylinder 22 is arranged to permit the thick portion 22 to substantially coincide with the position in the axial direction of the iron core 11*a* of the stator electromagnetic coil 11. As a result, the rotary magnetic field generated from the stator electromagnetic coil 11 during operation efficiently crosses the outer cylinder made of copper and performing the function of the rotor cylinder of the electromagnetic motor.

The construction of the rotor 20 according to one embodiment of the present invention will now be described with reference to FIGS. 5 to 7. An electric current owing to the electromagnetic induction caused by the rotary magnetic field applied from the stator electromagnetic coil flows through the outer cylinder 21. Therefore, the outer cylinder 21 is formed of a material having a high electric conductivity such as copper. Also, a blackened film (not shown) is formed on the surface of the outer cylinder 21 so as to facilitate the radiation of heat.

The outer cylinder 21 and the intermediate cylinder 22 are bonded to each other at the edge portion B1 close to the supporting shaft 16 bonded to the rotary anode disk, and the gap G1 for the heat insulation is formed between the outer cylinder 21 and the intermediate cylinder 22 except the bonded region B1. On the other hand, the intermediate cylinder 22 and the inner cylinder 23 are bonded to each other in the lower edge portion B2 in the drawing, which is remote from the supporting shaft 16 bonded to the rotary anode disk in terms of the heat transmission route.

Figure 5:
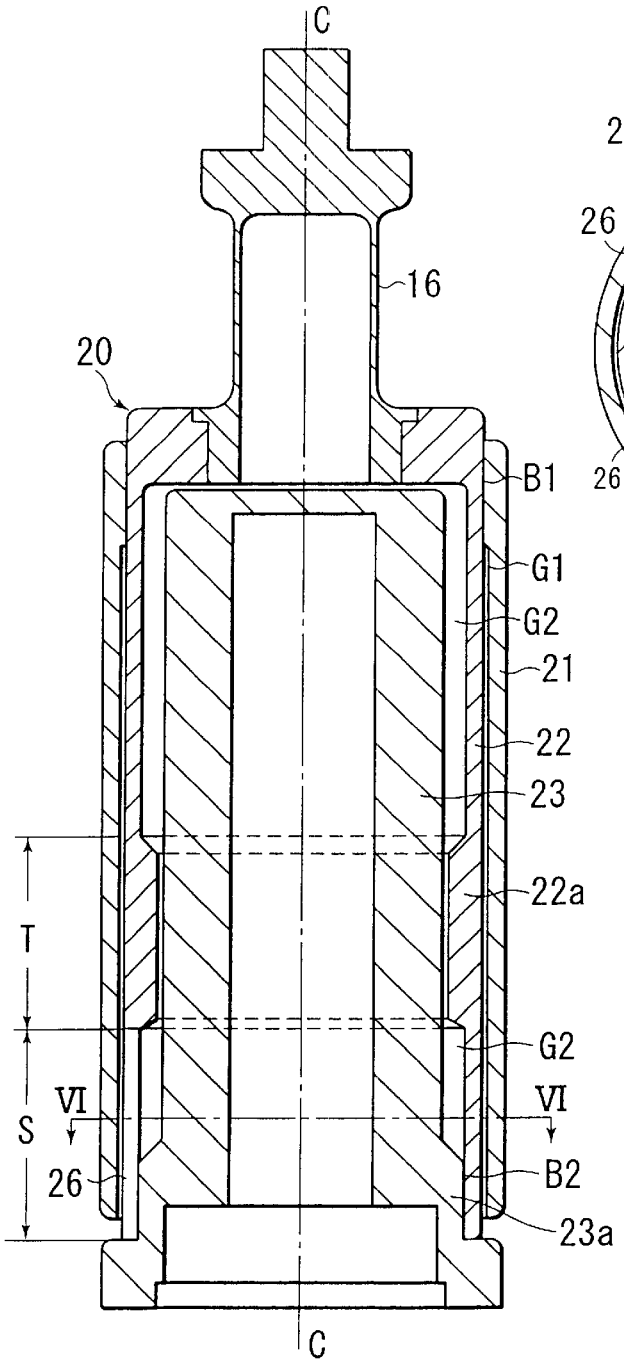
FIG. 5 is a cross sectional view showing in a magnified fashion a part of the rotary anode type X-ray tube apparatus shown in FIG. 4.
Figure 6:
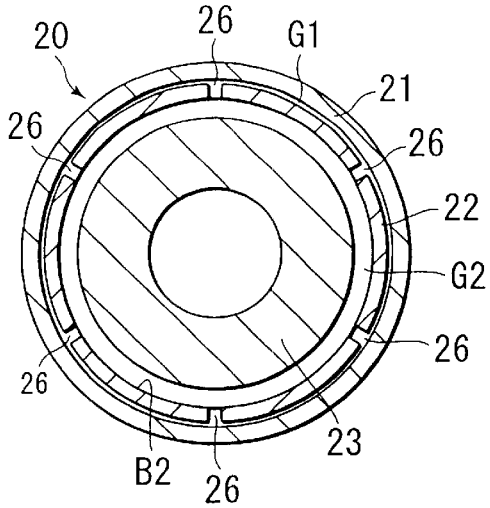
FIG. 6 is a lateral cross sectional view along the line VI—VI shown in FIG. 5.
Figure 7:
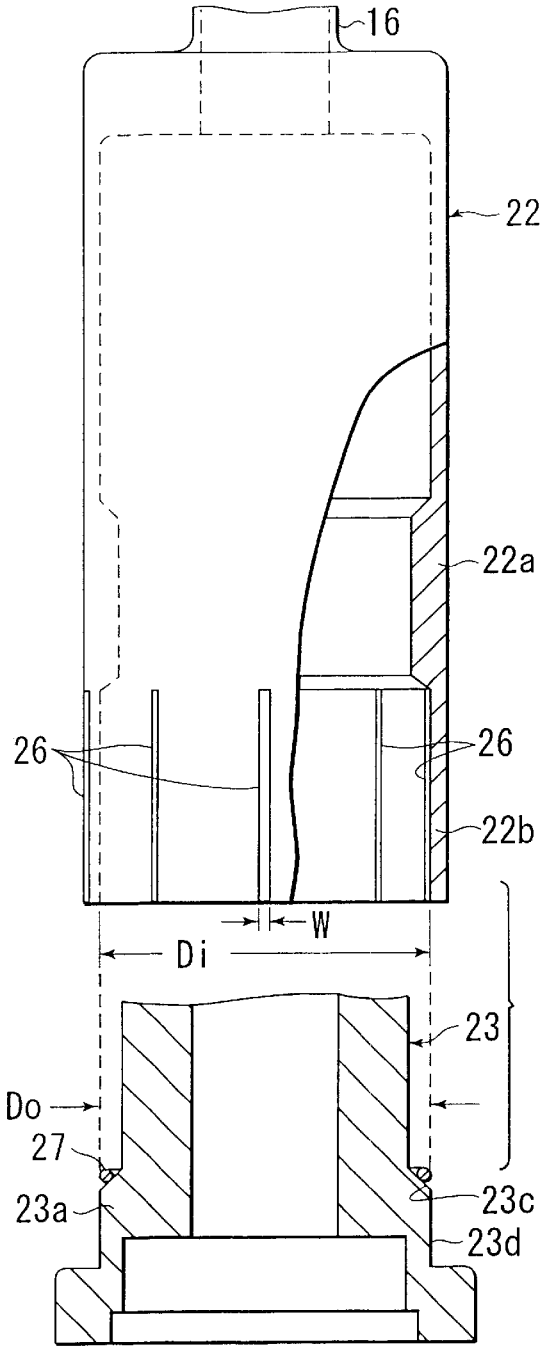
FIG. 7 is a vertical cross sectional view showing as a general idea of the assembled state of the structure shown in FIG. 5.

As shown in FIGS. 5 and 7, a large outer diameter portion 23*a* is formed in the lower edge in the drawing of the inner cylinder 23, and the outer circumferential surface 23*b* of the large outer diameter portion 23*a* is bonded to the inner circumferential surface of an open edge region 22*b* of the intermediate cylinder 22. A gap G2 for the heat insulation is formed between the intermediate cylinder 22 and the inner cylinder 23 except the bonded region B2. Incidentally, the gap G2 is formed larger than the gap G1 in the size in the radial direction. Also, the letter C denotes the axis of rotation.

As described previously, the thick portion 22*a* protruding inward is formed in a part, in the axial direction, of the tube of the inner circumferential surface of the intermediate cylinder 22. For example, the thick portion 22*a* is formed in a region surrounded by the iron core portion 11*a* of the stator electromagnetic coil arranged outside the vacuum envelope constituting the rotary anode X-ray tube. In this case, the region where the thick portion 22*a* is arranged is denoted by the letter T.

The thick portion 22*a* partially narrows the gap G2 for the heat insulation formed between the intermediate cylinder 22 and the inner cylinder 23. These intermediate and inner cylinders 22 and 23 are not brought into direct contact with each other at the thick portion 22*a* so as to maintain a predetermined gap for heat insulation.

A plurality of slits 26 are equidistantly arranged in the circumferential direction on the side of the open portion of the intermediate cylinder 22. As denoted by the letter S in FIG. 5, each of these slits 26 is formed to extend from the open edge of the intermediate cylinder 22 to reach a region contiguous to the thick portion 22*a* through the bonded region B2.

As described above, a plurality of slits 26, e.g., 6 slits 26, which extend in the axial direction from the open edge to a region in the vicinity of the thick portion 22*a*, are formed equidistantly apart from each other in the circumferential direction in the open edge region in which the intermediate cylinder 22 of the rotor is brazed to the inner cylinder 23. Suppose the intermediate cylinder 22 is formed of a 0.50Fe-0.50Ni alloy as described above and the inner diameter Di of the open region 22*b* is, for example, about 40 mm. Where the inner cylinder 23 is formed of TZM, the outer diameter Do of the brazed portion 23*b* expanded through a tapered portion 23*c* is made slightly larger than the inner diameter Di of the open portion of the intermediate cylinder. For example, the outer diameter Do is set at about 40.4 mm.

The width w of each slit 26 should preferably be relatively large in order to prevent the slit 26 from being filled with a molten brazing material due to the capillary action and to ensure a sufficiently high mechanical strength of the intermediate cylinder. To be more specific, the width w of each slit 26 should preferably be set to fall within a range of between 1.5 mm and 4 mm, e.g., should more preferably be set at about 2 mm. Also, in order to ensure a sufficiently high mechanical strength of the intermediate cylinder, the number of slits 26 should preferably fall within a range of between 3 and 12, e.g., the number of slits 26 should more preferably be set at 6 as described above.

In performing the brazing, the inner cylinder 23 is fixed to a tool (not shown) for determining the position, which is made of a material having a high melting point, and a ring-shaped gold brazing material 27 having a diameter not larger than the outer diameter Do of the brazed portion 23*b* is fitted to the tapered portion 23*c*. Under this condition, the gold brazing material 27 is tightly fitted to the brazed portion 23*b* of the inner cylinder 23 while slightly expanding from above the inner circumferential wall surface of the open edge portion 22*b* of the intermediate cylinder 22 along the tapered portion 23*c*. Since a plurality of slits 26 are formed in the intermediate cylinder 22, the gold brazing material 27 is gradually expanded in the slit region toward the open edge so as to be provisionally fixed with an inwardly shrinking stress exerted to the outer circumferential surface of the brazed portion 23*b* of the inner cylinder.

Then, the resultant structure is put in a brazing furnace (not shown) so as to be heated to about 1,100° C., thereby melting the gold brazing material, followed by gradually cooling the system so as to achieve the brazing. It should be noted that the thermal expansion coefficient of the inner cylinder 23 made of TZM is about $6\times10^{-6}$, and the thermal expansion coefficient of the intermediate cylinder made of a 0.5Fe-0.5Ni alloy is about $16\times10^{-6}$, which is more than twice the thermal expansion coefficient of TZM. It follows that a difference in the thermal expansion amount is generated between the inner cylinder 23 and the intermediate cylinder 22. However, since the outer diameter Do of the inner cylinder is set slightly larger than the inner diameter Di of the intermediate cylinder 22 as described above in view of the difference in the thermal expansion amount, the outer diameter Do and the inner diameter Di of the inner cylinder and the intermediate cylinder, respectively, are rendered substantially equal to each other at the solidifying temperature of the molten brazing material so as to be brazed under this condition. The molten brazing material flows mainly into the contact surface between the inner cylinder 23 and the intermediate cylinder 22 and flows partly into each of the corner portions defined between the circumferential wall of the slit 26 and the circumferential wall of the inner cylinder so as to integrally braze the inner and the intermediate cylinders.

At room temperature after the gradual cooling, the structure is returned to the pre-brazing state, i.e., the state that the inner diameter of the intermediate cylinder is gradually expanded slightly from a region in the vicinity of the thick portion toward the open edge brazed portion in the region where the slits 26 are formed. However, since the brazing step is employed as described above, the axis of the inner cylinder 23 is scarcely deviated from the axis of the intermediate cylinder 22 so as to permit the inner cylinder 23 and the intermediate cylinder 22 to be coaxial with a high accuracy.

As described above, the presence of the slits 26 is effective for achieving a coaxial structure, making it possible to prevent in advance the deviation of the axes of the inner cylinder and the intermediate cylinder from each other, even if the brazed structure of the inner cylinder 23 and the intermediate cylinder 22 differ from each other in the thermal expansion coefficient. In addition, the presence of the slits 26 also serves to suppress the transmission of heat generated from the rotary anode disk to the inner cylinder constituting the hydrodynamic slide bearing surface, though the suppression effect is small. In addition, the presence of the slits 26 further serves to discharge to the outside the air in the gap G2 for the heat insulation between the intermediate cylinder and the inner cylinder in the exhaust process of the X-ray tube.

Incidentally, where the inner cylinder 23 is made of SKD-11, it is advisable to have the inner cylinder 23 and the intermediate cylinder 22 coupled with each other with the inner diameter Di and the outer diameter Do of the brazed portion set substantially equal to each other under the assembled state before the brazing because the thermal expansion coefficient of the inner cylinder 23 is close to that of the intermediate cylinder made of a 0.50Fe-0.50Ni alloy.

On the contrary, where the thermal expansion coefficient of the intermediate cylinder 22 is small, the clearance of the coupled portion where the intermediate cylinder 22 is brazed to the inner cylinder 23 is rendered large under room temperature. However, since the slits 26 are formed in the intermediate cylinder 22, the open edge portion of the intermediate cylinder is shrunk together with the bonded portion B2 even if the inner cylinder 23 is thermally shrunk in the cooling step so as to achieve a satisfactory brazing.

In the embodiment described above, the slit 26 is. formed to extend from the edge portion of the intermediate cylinder 22 on the opposite side of the rotary anode to reach a region contiguous to the thick portion 22*a* on the side of the rotary anode disk through the bonded portion B2. In this case, since the slit 26 is formed in a thin portion in a manner to avoid the thick portion 22*a*, the portion of the slit 26 is easily deformed. Therefore, when the inner cylinder 23 is coupled with the intermediate cylinder 23, or when the stress generated in the bonded portion B2 is absorbed, the slit 26 is deformed over a wide range so as to ensure a satisfactory bonded state. As a result, the axes of the intermediate cylinder 22 and the inner cylinder 23 are not deviated from each other so as to realize a rotor having satisfactory rotating characteristics.

It should be noted that, if the slit 26 is formed in a part of the intermediate cylinder 22, a problem is generated that the guide effect of the rotary magnetic field is somewhat lowered. However, in the structure described above, the thick portion 22*a* is formed in a part of the intermediate cylinder 22, with the result that the guide effect of the rotary magnetic field is scarcely lowered so as to realize a rotor having good rotating characteristics. In this case, if the thick portion is formed to extend over a wide range of the intermediate cylinder 22, the heat conductivity is increased so as to lower the effect of suppressing the heat conduction. Therefore, for suppressing the heat conduction, it is desirable to form the thick portion within a region surrounded by the iron core portion of the stator electromagnetic coil.

Figure 8:
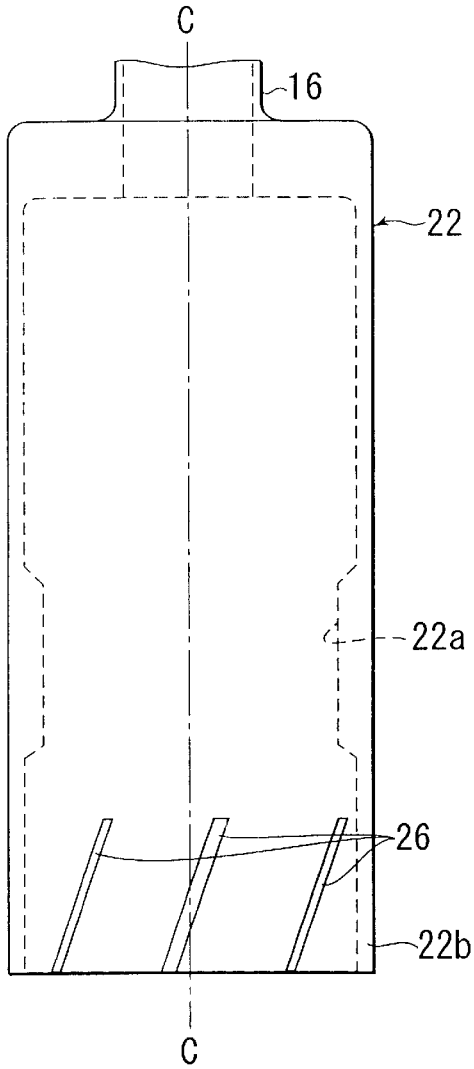
FIG. 8 is a side view schematically showing a part of the rotary anode type X-ray tube apparatus according to another embodiment of the present invention.

FIG. 8 shows another embodiment of the present invention. In the embodiment shown in FIG. 8, the slits 26 in the open edge region of the intermediate cylinder 22 are formed to extend oblique relative to the axis C. The effects similar to those described previously can also be obtained in this embodiment.

Figure 9:
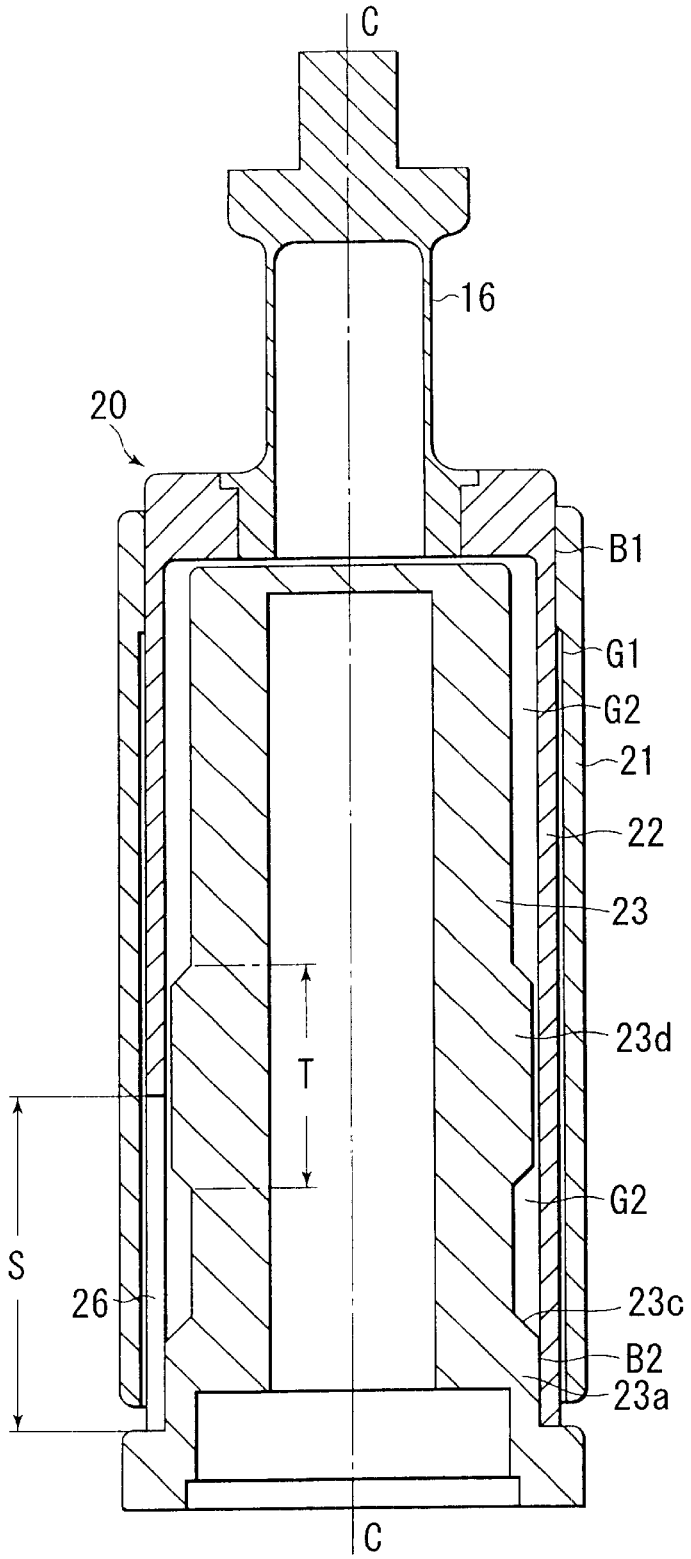
FIG. 9 is a side view schematically showing a part of the rotary anode type X-ray tube apparatus according to still another embodiment of the present invention.

FIG. 9 shows still another embodiment of the present invention. In the embodiment shown in FIG. 9, the inner cylinder 23 is made of a ferromagnetic material, and a thick portion 23*d* protruding outward and extending in the axial direction is formed in the inner cylinder 23 over a length T. The iron core portion of the stator electromagnetic coil (not shown) is located in the position in the axial direction corresponding to the position of the thick portion 23*d* so as to permit the iron core portion noted above to face the thick portion 23*d*. In this embodiment, the slit 26 formed on the side of the open edge portion of the intermediate cylinder 22 extends from the bonded portion B1 between the intermediate cylinder 22 and the inner cylinder 23 to reach a point midway of the thick portion 23*d* so as to provide a length S shown in the drawing. The effects similar to those described previously can also be obtained in this embodiment. Particularly, even if the relatively long slit 26 is formed, the guide efficiency of the rotary magnetic field is scarcely impaired because of the presence of the thick portion 23*d* of the inner cylinder that is made of a ferromagnetic material. In the structure of this embodiment, it is possible to use a material having a relatively low specific permeability such as a stainless steel for forming the intermediate cylinder 22. Since the heat conductivity of the stainless steel is, for example, about one fifth of that of Mo, it is possible to use the stainless steel for forming the intermediate cylinder 22.

In the embodiment described above, the intermediate cylinder is partly thickened, and the slits are formed in the intermediate cylinder. However, it suffices to form the slits in the intermediate cylinder. A rotary anode type X-ray tube exhibiting good rotational characteristics can be realized in this case, too.

As described above, the present invention provides a rotary anode type X-ray tube that is substantially free from deviation of the axes of a plurality of coaxial cylinders forming the rotor so as to exhibit good rotating characteristics and an X-ray tube apparatus using the particular rotary anode type X-ray tube.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A rotary anode type X-ray tube having an axis of rotation, comprising:

a rotary anode disk including a target region for emitting an X-ray;

a substantially columnar stator;

a cylindrical first rotor coupled around said stator and supporting said rotary anode disk;

a hydrodynamic slide bearing region including a spiral groove and arranged between the stator and said first cylindrical rotor; and a cylindrical second rotor arranged coaxial with and outside the first cylindrical rotor with a gap for the heat insulation provided therebetween and bonded directly or indirectly to the rotary anode disk, said second cylindrical rotor being bonded to said first cylindrical rotor in an open region positioned remote from the rotary anode disk in terms of the heat transmission route;

wherein a plurality of slits extending substantially along the axis of rotation are formed apart from each other in the circumferential direction in that region of said second cylindrical rotor which is bonded to said first cylindrical rotor.

2. The rotary anode type X-ray tube according to claim 1, wherein said first cylindrical rotor is brazed to said second cylindrical rotor.

3. The rotary anode type X-ray tube according to claim 1, wherein said first cylindrical rotor and said second cylindrical rotor are made of different metals.

4. The rotary anode type X-ray tube according to claim 1, wherein the heat conductivity of said second cylindrical rotor is lower than that of said first cylindrical rotor.

5. A rotary anode type X-ray tube apparatus, comprising:

a rotary anode type X-ray tube having an axis of rotation and including a vacuum envelope, a rotary anode disk arranged within said vacuum envelope and including a target region for emitting an X-ray, a substantially columnar stator arranged within the vacuum envelope, a cylindrical first rotor coupled around said stator and supporting said rotary anode disk, a hydrodynamic slide bearing including a spiral groove and arranged in the coupled portion between the stator and said first cylindrical rotor, and a cylindrical second rotor arranged coaxial with and outside the first cylindrical rotor with a gap for the heat insulations provided therebetween and bonded directly or indirectly to the rotary anode disk, said second cylindrical rotor being bonded to said first cylindrical rotor in an open region positioned remote from the rotary anode disk in terms of the heat transmission route; and a stator electromagnetic coil prepared by winding a coil of conductive wire about an iron core and arranged around said first cylindrical rotor and said second cylindrical rotor outside the vacuum envelope of said rotary anode type X-ray tube;

wherein a thick portion is formed in the first cylindrical rotor or the second cylindrical rotor of said rotary anode type X-ray tube in a manner to partially narrow the heat insulation gap formed between the first and second cylindrical rotors, a plurality of slits extending substantially along the axis of rotation are formed apart from each other in the circumferential direction in that region of the second cylindrical rotor which is bonded to the first cylindrical rotor, and the iron core portion of said stator electromagnetic coil is located in the outer circumferential region in the position in the axial direction corresponding to said thick portion.

6. The rotary anode type X-ray tube apparatus according to claim 5, wherein said first cylindrical rotor or said second cylindrical rotor, which includes said thick portion, is formed of a ferromagnetic material.

* * * * *